US008434439B2

(12) United States Patent
Richter et al.

(10) Patent No.: US 8,434,439 B2
(45) Date of Patent: May 7, 2013

(54) CLUTCH OR BRAKE IN OR AT A GEARBOX

(75) Inventors: Frank Richter, Oberteuringen (DE); Ilja Imgrunt, Friedrichshafen (DE); Konrad Thoma, Friedrichshafen (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 12 days.

(21) Appl. No.: 13/321,338

(22) PCT Filed: Mar. 12, 2010

(86) PCT No.: PCT/EP2010/053159
§ 371 (c)(1),
(2), (4) Date: Nov. 18, 2011

(87) PCT Pub. No.: WO2010/139491
PCT Pub. Date: Dec. 9, 2010

(65) Prior Publication Data

US 2012/0067315 A1 Mar. 22, 2012

(30) Foreign Application Priority Data

Jun. 2, 2009 (DE) ..... 10 2009 026 626

(51) Int. Cl.
*F01L 1/34* (2006.01)

(52) U.S. Cl.
USPC ..... 123/90.17

(58) Field of Classification Search ..... 123/90.15, 123/90.17; 464/160, 161
See application file for complete search history.

(56) References Cited

U.S. PATENT DOCUMENTS

| | | | | |
|---|---|---|---|---|
| 6,622,677 | B2 | 9/2003 | Simpson et al. | |
| 6,799,544 | B1 * | 10/2004 | Pierik | 123/90.17 |
| 7,032,552 | B2 | 4/2006 | Schafer et al. | |
| 7,841,312 | B2 * | 11/2010 | Richter | 123/90.17 |
| 2002/0100444 | A1 | 8/2002 | Todo et al. | |
| 2003/0070641 | A1 | 4/2003 | Watanabe et al. | |

FOREIGN PATENT DOCUMENTS

| | | | |
|---|---|---|---|
| DE | 102 20 687 | A1 | 11/2003 |
| DE | 10 2004 045 631 | A1 | 4/2006 |
| DE | 10 2006 011 806 | A1 | 7/2007 |
| EP | 1 338 761 | A1 | 8/2003 |
| JP | 2003-049615 | A | 2/2003 |

* cited by examiner

*Primary Examiner* — Thomas Denion
*Assistant Examiner* — Daniel Bernstein
(74) *Attorney, Agent, or Firm* — Davis & Bujold, PLLC

(57) ABSTRACT

A clutch or brake with an electrically actuated switching coil and an armature that axially moves toward the switching coil and forms a connection with the switching coil and can rotate relative to the switching coil, in an adjustment system for camshafts of a combustion engine. A superposition transmission has an input driven by a crankshaft of the engine, a drive output element that drives a camshaft of the engine and a control element, by which relative rotation between the input and the output can be produced by applying a braking torque. The armature is rotationally fixed and axially slidable, and centered on or at a transmission component, and the switching coil is rotationally fixed and centered coaxially with the armature by a membrane spring on a further transmission component, relative to which the armature is braked or to which the armature is coupled.

7 Claims, 1 Drawing Sheet

CLUTCH OR BRAKE IN OR AT A GEARBOX

This application is a National Stage completion of PCT/EP2010/053159 filed Mar. 12, 2010, which claims priority from German patent application serial no. 10 2009 026 626.7 filed Jun. 2, 2009.

FIELD OF THE INVENTION

The invention concerns a clutch or brake with an electrically actuated switching coil and an armature that can move axially toward the switching coil, which brings about a frictional or interlocked connection with the switching coil and which can rotate relative to the switching coil.

BACKGROUND OF THE INVENTION

Such clutches or brakes are used for example in adjustment systems for camshafts of an internal combustion engine, which comprise a superposition transmission with a drive input element driven by a crankshaft of the internal combustion engine, with a drive output element that drives a camshaft of the internal combustion engine and with a control element by means of which, by applying a braking torque, relative rotation can be produced between the drive input element and the drive output element. However, electromagnetically actuated clutches or brakes can also be used as shifting elements in automatic transmissions, in order therein to couple rotating transmission components to one another or to brake them relative to a transmission housing.

DE 10 2006 011 806 A1 describes an adjustment device for a camshaft, which comprises a brake system and a superposition transmission connected on the output side to the camshaft and on the input side to the crankshaft, such that to adjust the camshaft the superposition transmission diverts part of the input-side energy into the brake system. The frictional brake system produces the necessary braking force by virtue of a friction lining which is permanently in a slipping condition, in that a switching coil on an armature, to which the friction lining is fixed, acts by virtue of electrical regulation and, depending on the necessary phase position, produces a corresponding braking torque. This adjustment device comprises additional, mechanical locking means which come into effect when the switching coil is not energized, in that the armature is pushed axially by a spring so that an adjustment shaft is connected with interlock to the drive input element of the superposition transmission. The switching coil is fixed onto the housing and needs to be adjusted relative to the armature with the friction lining which is arranged in a rotationally fixed manner and axially movably on the adjustment shaft.

DE 102 20 687 A1 describes a similar adjustment device, which also comprises a superposition transmission with a drive input element driven by a crankshaft of the internal combustion engine, a drive output element that drives a camshaft of the internal combustion engine, and a control element by which a relative rotation between the drive input and the drive output elements can be produced by virtue of an electric motor control drive that acts on the control element. In addition an electromagnetic brake is also provided between the control element and a fixed part of the housing, by means of which a basic or emergency position of the camshaft can be reached and held. This adjustment device for a camshaft is represented only schematically and it cannot be seen how the electric motor control drive and the electromagnetic brake are mounted relative to the housing part and the superposition transmission.

SUMMARY OF THE INVENTION

The purpose of the present invention is to propose a clutch or brake in a transmission, consisting of an electrically actuated switching coil and an armature that can move toward the switching coil, forming a frictional or interlocked connection with the switching coil and being able to rotate relative to the switching coil, which in a simple manner enables axial manufacturing tolerances and thermal expansions between the components to be compensated.

This objective is achieved with a clutch or brake having the characteristics specified in the description below.

Thus, the invention starts with a clutch or brake having an electrically actuated switching coil and an armature that can move axially toward the switching coil, which forms a frictional or interlocking connection with the switching coil and which can rotate relative to the switching coil, in a transmission, for example in an adjustment system for camshafts of an internal combustion engine, which comprises a superposition transmission with a drive input element driven by a crankshaft of the internal combustion engine, a drive output element that drives a camshaft of the internal combustion engine and a control element by which relative rotation between the drive input and drive output elements can be produced by applying a braking torque.

To achieve the stated objective it is also provided that the armature is arranged centered in a rotationally fixed and displaceable manner on or at a transmission component, and the switching coil is fixed, in a rotationally fixed manner and coaxially centered relative to the armature, by means of a membrane spring on a further transmission component, being braked relative to the armature or coupled thereto.

By virtue of the membrane spring the torque acting between the switching coil and the armature and thus between the transmission components is transmitted, and at the same time axial manufacturing tolerances between these transmission components are compensated. Thermal expansion between the transmission components is also compensated by the membrane spring, without this producing appreciable or impeding axial or radial forces.

Preferably, the transmission component on which the armature is arranged can be a transmission shaft on which the switching coil is mounted so that it can rotate but cannot be displaced. In this way the transmission shaft is centered and mounted relative to the transmission component on which the switching coil is fixed by means of the membrane spring, while the axial manufacturing tolerances between the transmission component and the transmission shaft, and any thermal expansion, are taken up by the membrane spring.

The transmission component to which the switching coil is fixed can be a rotationally fixed housing component; in particular, the switching coil can be attached to a rotationally fixed housing element of the superposition transmission for a camshaft adjusting system of an internal combustion engine, while the armature is arranged on a control element of the superposition transmission in the form of an adjustment shaft.

Since the adjustment system for camshafts of an internal combustion engine is typically arranged with the camshaft in an engine housing, it is advantageous for the superposition transmission to be in the form of a three-shaft transmission arranged in the engine housing, with a drive input shaft connected to the crankshaft, a drive output shaft connected to the camshaft and an adjustment shaft, such that the switching coil is fixed by means of the membrane spring onto the engine housing component and mounted on the adjustment shaft by at least one roller bearing, while the armature is arranged in a rotationally fixed manner but axially movably on the adjustment shaft.

In order to ensure complete separation of the armature from the switching coil when the switching coil is not energized with current, a compression spring that acts in the opening direction can be arranged between the armature and switching coil.

The design principle described and its further developments are expressly not restricted to application in the context of an adjustment system for camshafts of an internal combustion engine, but can also be used with the same advantages for electro-mechanically actuated clutches or brakes in automatic transmissions.

BRIEF DESCRIPTION OF THE DRAWINGS

Below, the invention is explained in more detail with reference to an example embodiment represented in the drawings, which show.

DETAILED DESCRIPTION OF THE PREFERRED EMBODIMENTS

Figure 1:
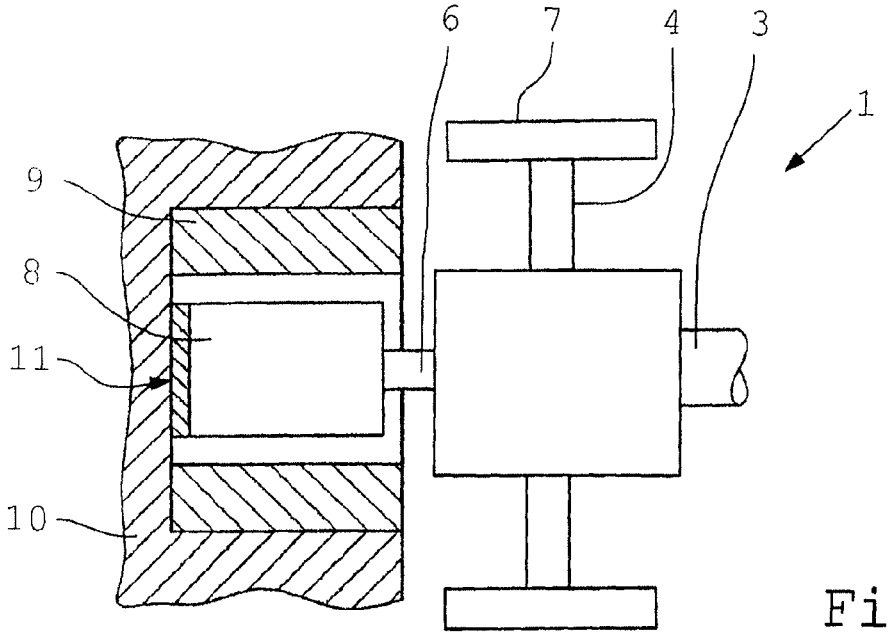
FIG. 1: A schematic representation of an adjustment system for camshafts of an internal combustion engine, with a superposition transmission, an electro-magnetic clutch or brake and an electric motor adjustment drive.

The adjustment system for camshafts of an internal combustion engine comprises a superposition transmission 1 whose drive input element 4, which is driven by a crankshaft of the internal combustion engine, is connected to the crankshaft via a drive gearwheel 7. In addition, the superposition transmission 1 comprises a drive output element 3 that drives a camshaft of the internal combustion engine and a control element 6, the latter being connected to an electric motor control drive consisting of a rotor 8 and a stator 9. The stator 9 is fixed in an engine housing component 10 in a rotationally fixed and axially immobile manner.

Between the engine housing component 10 and the rotor 8 is arranged an electromagnetic brake 11 which serves, for example in the event that the electric motor control drive 8, 9 fails, to reach and hold a basic or emergency position of the drive output element 3 connected to a camshaft by braking or fixing the adjustment shaft 6.

Figure 2:
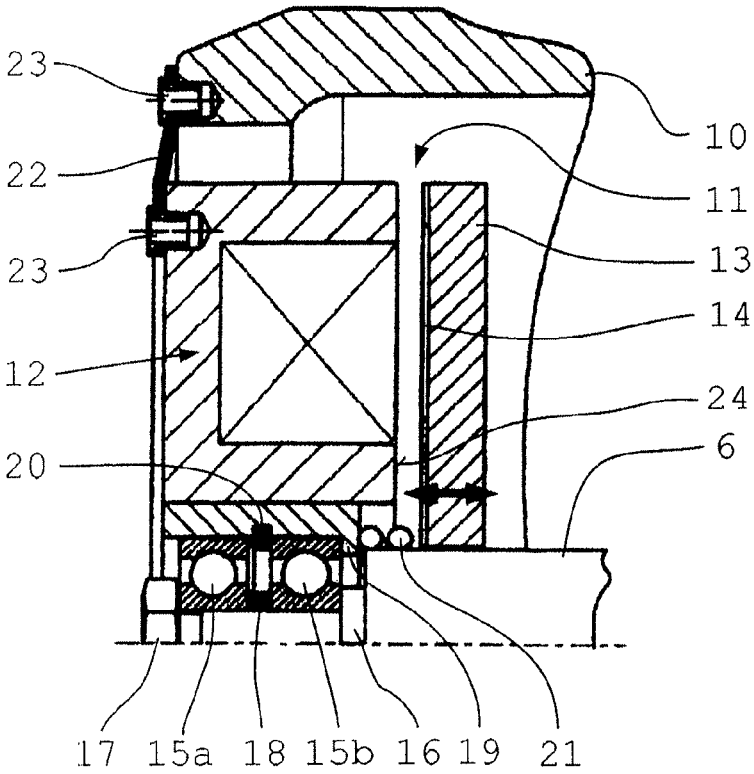
FIG. 2: An enlarged, detailed view of the clutch or brake according to the invention.

As can be seen in FIG. 2, the electromagnetic brake 11 comprises a switching coil 12 which is connected to the engine housing component 10 by a membrane spring 22, the membrane spring 22 being screwed both to the switching coil 12 and to the engine housing 10 by means of fixing screws 23.

The switching coil 12 also serves to mount the free end of the adjustment shaft 6 by means of two grooved ball bearings 15*a*, 15*b*. The inner rings of these grooved ball bearings 15*a*, 15*b* are axially clamped onto a shaft stub of the adjustment shaft 6 by means of an expansion bolt or nut 17 against a step 16 on the adjustment shaft 6 with interposition of a spacer ring 18. The outer ring of the grooved ball bearing 15*b* nearest the step is fixed axially on a collar 19 of the switching coil 12 and fixed axially by a circlip 20 on the opposite side, while the other grooved ball bearing 15*a* is in the form of a loose bearing with a loose outer ring.

Owing to the elasticity of the membrane spring 22, axial manufacturing tolerances between the engine housing components 10, the adjustment shaft 6 and the superposition transmission 1 are compensated. Furthermore, any thermal expansion of the elements of the superposition transmission 1 relative to the engine housing component 10 is taken up by the membrane spring 22, without this having any effect on the mounting of the adjustment shaft 6 in the switching coil 12. Correspondingly, the superposition transmission 1 is relieved from transverse forces and vibrations, since the adjustment shaft 6 remains securely centered relative to the engine housing component 10 by virtue of the grooved ball bearings 15*a* and 15*b*, the switching coil 12 and the membrane spring 22 in any operating condition.

In addition an armature 13 can be moved axially on the adjustment shaft 6 and is arranged in a rotationally fixed manner. A friction lining 14 on an end of the armature 13 co-operates with a corresponding friction surface 24 on the end of the switching coil 12. A compression spring 21 serves to move the armature 13 to a release position when the switching coil 12 is not energized, such that there is no contact between the switching coil 12 and the friction lining 14 of the armature 13. The double arrow shown on the armature 13 indicates its directions of possible movement.

The example embodiment illustrated and described relates to an electromagnetic, frictionally operating brake 11 in a superposition transmission 1 of an adjustment system for camshafts of an internal combustion engine which, however, can also be designed to operate with positive interlock. The invention can also be used to produce a clutch or brake in an automatic transmission, and can serve to fix rotating transmission elements relative to a transmission housing component or to couple rotating transmission elements to one another.

LIST OF INDEXES

1 Transmission, superposition transmission
3 Drive output element, output shaft
4 Drive input element, input shaft
6 Adjustment element, adjustment shaft
7 Drive gearwheel
8 Rotor
9 Stator
10 Engine housing component, transmission component
11 Electromagnetic brake
12 Switching coil
13 Armature
14 Friction lining
15*a* Roller bearing, grooved ball bearing
15*b* Roller bearing, grooved ball bearing
16 Step
17 Nut
18 Spacer ring
19 Collar
20 Circlip
21 Compression spring
22 Membrane spring
23 Fixing screws
24 Friction surface on the face of the switching coil

The invention claimed is:

1. A clutch or brake (11) with an electrically actuated switching coil (12) and an armature (13) that is axially movable toward the switching coil (12) to form a either a frictional or an interlocked connection with the switching coil (12) and being rotatable relative to the switching coil (12), in a transmission (1) comprising a superposition transmission (1) with a drive input element (4) that is driven by a crankshaft of an internal combustion engine, a drive output element (3) that drives a camshaft of the internal combustion engine, and a control element by which relative rotation between the drive input element (4) and the drive output element (3) is produced by applying a braking torque, the armature (13) being arranged in a rotationally fixed and displaceable manner, centered either on or at a transmission component (6), and the switching coil (12) being attached in a rotationally fixed manner and centered coaxially with the armature (13) by a membrane spring (22) on a further transmission component (10), relative to which either the armature (13) being braked or the armature (13) being coupled.

2. The clutch or brake according to claim 1, wherein the transmission component (6), on which the armature (13) is arranged, is a transmission shaft, and the switching coil (12) is mounted on the transmission shaft (6) such that the switching coil (12) can rotate but cannot be displaced.

3. The clutch or brake according to claim 1, wherein the transmission component (10), onto which the switching coil (12) is attached, is a rotationally fixed housing component.

4. The clutch or brake according to claim 3, wherein the switching coil (12) is attached to a rotationally fixed housing element of the superposition transmission (1) for a camshaft adjustment system of an internal combustion engine, and the armature (13) is arranged on a control element (6) of the superposition transmission (1) in the form of an adjustment shaft.

5. The clutch or brake according to claim 4, wherein the superposition transmission (1) is a three-shaft transmission arranged in an engine housing component (10), the drive input shaft (4) is connected to the crankshaft, a drive output shaft (3) is connected to the camshaft and an adjustment shaft (6) such that the switching coil (12) is attached by the membrane spring (22) to the engine housing component (10) and is mounted on the adjustment shaft (6) by at least one roller bearing (15*a*, 15*b*), and such that the armature (13) is arranged in a rotationally fixed manner and axially moveably on the adjustment shaft (6).

6. A clutch or brake (11) with an electrically actuated switching coil (12) and an armature (13) that is axially movable toward the switching coil (12) to form a either a frictional or an interlocked connection with the switching coil (12) and which is rotatable relative to the switching coil (12), in a transmission (1) comprising a superposition transmission (1) with a drive input element (4) being driven by a crankshaft of an internal combustion engine, a drive output element (3) driving a camshaft of the internal combustion engine, and a control element by which a relative rotation between the drive input element (4) and the drive output element (3) being produced by applying a braking torque, the armature (13) being arranged in a rotationally fixed and displaceable manner, centered either on or at a transmission component (6), and the switching coil (12) being attached in a rotationally fixed manner and centered coaxially with the armature (13) by a membrane spring (22) on a further transmission component (10), relative to which either the armature (13) being braked or the armature (13) being coupled, and a compression spring (21), which acts in an opening direction, being arranged between the armature (13) and the switching coil (12).

7. A coupling (11) comprising an electrically actuated switching coil (12) and an armature (13), the armature (13) being axially movable in relation to the switching coil (12) to form an engagement with the switching coil (12) and being rotatable relative to the switching coil (12), a superposition transmission (1) comprising a drive input element (4) being driven by a crankshaft of an internal combustion engine, a drive output element (3) driving a camshaft of the internal combustion engine, and a control element for producing relative rotation between the drive input element (4) and the drive output element (3) by applying a braking torque, the armature (13) being supported on a transmission component (6) in a rotationally fixed and axially displaceable manner, and the switching coil (12) being attached in a rotationally fixed manner and centered coaxially with the armature (13) by a membrane spring (22) on a further transmission component (10), relative to which the armature (13) being braked or to which the armature (13) being coupled.

* * * * *